US010773741B2

(12) United States Patent
Rosti et al.

(10) Patent No.: US 10,773,741 B2
(45) Date of Patent: Sep. 15, 2020

(54) TRAFFIC MANAGEMENT METHOD AND TRAFFIC MANAGEMENT SYSTEM

(71) Applicant: ALSTOM TRANSPORT TECHNOLOGIES, Saint-Ouen (FR)

(72) Inventors: Massimo Rosti, Crevalcore (IT); Davide Nucci, Bologna (IT); Antonio Di-Carmine, Bologna (IT)

(73) Assignee: ALSTOM TRANSPORT TECHNOLOGIES, Saint-Ouen (FR)

( * ) Notice: Subject to any disclaimer, the term of this patent is extended or adjusted under 35 U.S.C. 154(b) by 22 days.

(21) Appl. No.: 16/098,217

(22) PCT Filed: May 5, 2017

(86) PCT No.: PCT/EP2017/060806
§ 371 (c)(1),
(2) Date: Nov. 1, 2018

(87) PCT Pub. No.: WO2017/194416
PCT Pub. Date: Nov. 16, 2017

(65) Prior Publication Data

US 2019/0161102 A1 May 30, 2019

(30) Foreign Application Priority Data

May 9, 2016 (EP) ..... 16305538

(51) Int. Cl.
*B61L 27/00* (2006.01)

(52) U.S. Cl.
CPC ..... *B61L 27/0027* (2013.01); *B61L 27/0011* (2013.01); *B61L 27/0016* (2013.01); *B61L 27/0022* (2013.01)

(58) Field of Classification Search
CPC ..... B61L 27/0027; B61L 27/0011; B61L 27/0016; B61L 27/0022
(Continued)

(56) References Cited

U.S. PATENT DOCUMENTS 6,459,964 B1 * 10/2002 Vu ..... B61L 27/0016 701/19
2006/0074544 A1 * 4/2006 Morariu ..... B61L 27/0027 701/117
2014/0346286 A1 * 11/2014 Tonguz ..... B61L 15/0027 246/182 R

FOREIGN PATENT DOCUMENTS

EP 2913244 A1 9/2015
EP 2962916 A1 1/2016
(Continued)

OTHER PUBLICATIONS

International Search Report for PCT/EP2017/060806 dated Jul. 12, 2017.
(Continued)

*Primary Examiner* — Marthe Y Marc-Coleman
(74) *Attorney, Agent, or Firm* — Pearne & Gordon LLP

(57) ABSTRACT

A traffic management method, for managing traffic of a transportation network, comprising the steps of managing the traffic and the transportation network, according to a basis instruction timetable, automatically detecting and/or predicting a conflict in the traffic, generating a conflict solution in knowledge of the conflict, and managing the traffic and the transportation network with a modified instruction timetable based on the generated conflict solution. In the invention, the step of generating the conflict solution comprises the sub-steps of automatically splitting the transportation network into a local part, in which the conflict is involved, and a complementary part distinct from the local part, automatically generating a local solution relative only to the local part, automatically generating a complementary solution relative only to the complementary part, the complementary solution being generated in consideration of the local solution, and automatically combining
(Continued)

Figure 1:
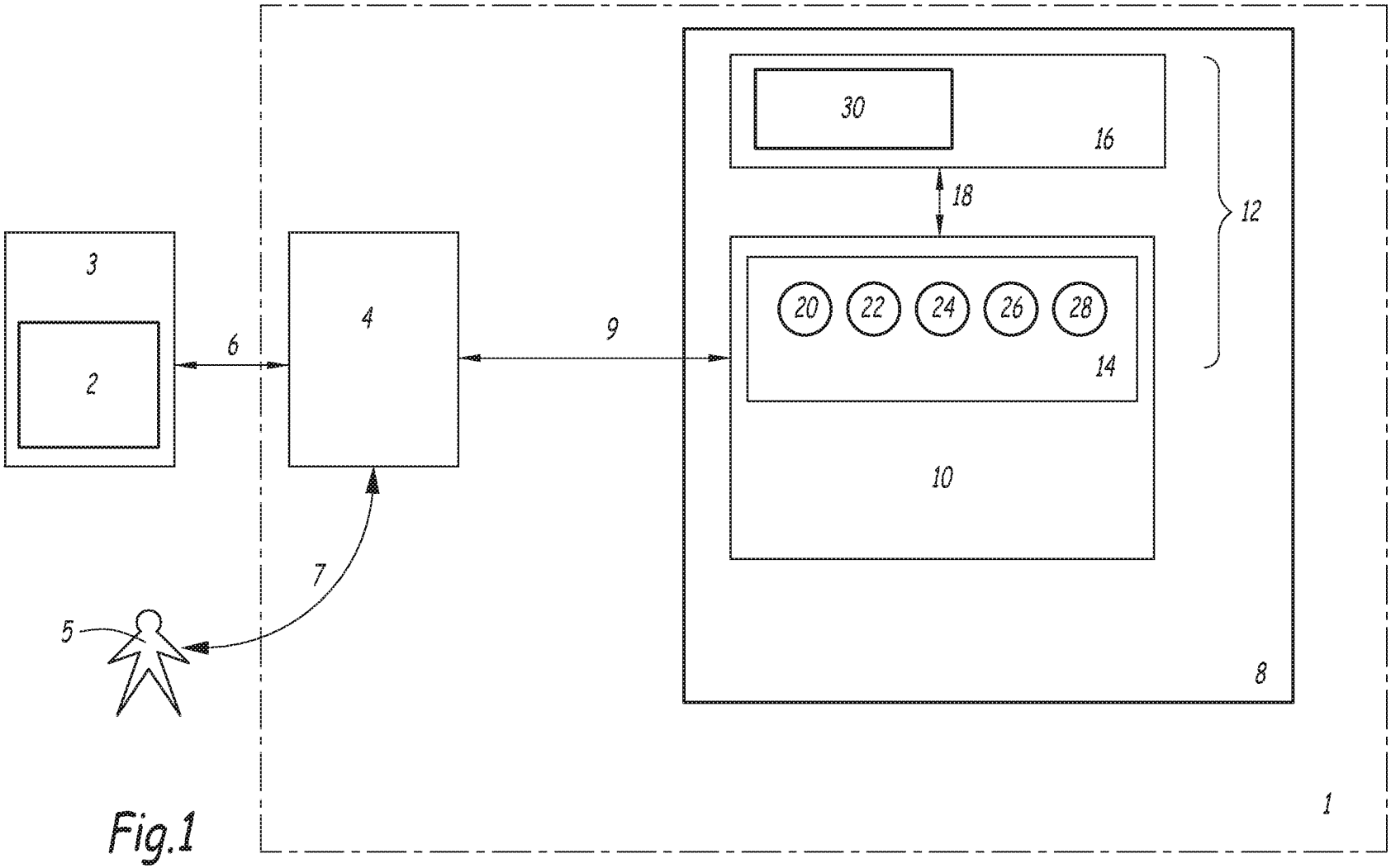

the local and complementary solutions for obtaining the conflict solution.

10 Claims, 2 Drawing Sheets

(58) Field of Classification Search
USPC ..... 701/19
See application file for complete search history.

(56) References Cited

FOREIGN PATENT DOCUMENTS

| | | | |
|---|---|---|---|
| GB | 2516383 | A | 1/2015 |
| JP | H04283163 | A | 10/1992 |
| WO | 2013112885 | A2 | 8/2013 |

OTHER PUBLICATIONS

Extended European Search Report for EP 16305538.7 dated Oct. 31, 2016.
Te-We Chiang et al; "Railway Scheduling System Using Repair-based Approach"; Proceedings of the 7th International Conference on Tools With Artificial Intelligence, Herndon, Va., Nov. 5-8, 1995; pp. 71-78, Los Alamitos, Ca: IEEE Computer Soc, US, XP010163256,ISBN: 978-0-8186-7612-2 paragraph [04.2].

* cited by examiner

TRAFFIC MANAGEMENT METHOD AND TRAFFIC MANAGEMENT SYSTEM

This is a National Stage application of PCT international application PCT/EP2017/060806, filed on May 5, 2017 which claims the priority of European Patent Application No. 16305538.7 entitled "Traffic management method and traffic management system", filed May 9, 2016, both of which are incorporated herein by reference in their entirety.

The present invention concerns a traffic management method and a traffic management system configured to perform the steps of said method.

The present invention relates in particular to the management of traffic, such as a set of trains, of a transportation network, such as a railway network. The operation of the traffic is performed based on a predetermined timetable. However, traffic disruption may occur, in case vehicles of the traffic are brought in conflict with other vehicles, with a disrupted element of the transportation network or with external elements. An automatic or semi-automatic traffic management system may be provided for solving the conflicts by proposing an optimal modified timetable for managing the traffic, thanks to which the consequences of the disruptions are mitigated as much as possible.

An example of such a traffic management system is disclosed in EP-A1-2 913 244. This particular disclosed traffic management system is configured for generating, when a timetable disruption has occurred, a timetable that prioritizes the time points of train arrivals and departures provided that the total cost, based on electrical power consumption required for train operation and the degree of the effect of delays in the form of monetary costs associated with train operation, is lower than that of a timetable that is anticipated to occur due to the timetable disruption.

However, in most known traffic management systems, the generation of an optimal instruction timetable often requires an important computing load and thus may take time, depending on the available computing resources, since the problem to be solved by the system is of exponential complexity. Thus, real-time generation of new timetables is hardly possible to achieve.

Consequently, the invention seeks to solve these aforementioned drawbacks of the prior art by providing a new traffic management method which requires little computation resources and is therefore especially fast to perform.

The object of the invention is a traffic management method according to claim 1.

Combining a local solution with a complementary solution is faster than generating a conflict solution for the entire transportation network, since the sub-step of generating the local solution allows reducing the number of alternatives possibilities to be calculated for generating the complementary solution. Furthermore, the conflict solution is easier to understand for an operator willing to manage future traffic so as to avoid conflicts, since the generated conflict solution implies modifications of the instruction timetable which are local to the detected and/or predicted conflict.

Further optional and advantageous features of the invention are defined in claims 2 to 8.

Another object of the invention is a traffic management system according to claim 9.

Figure 2:
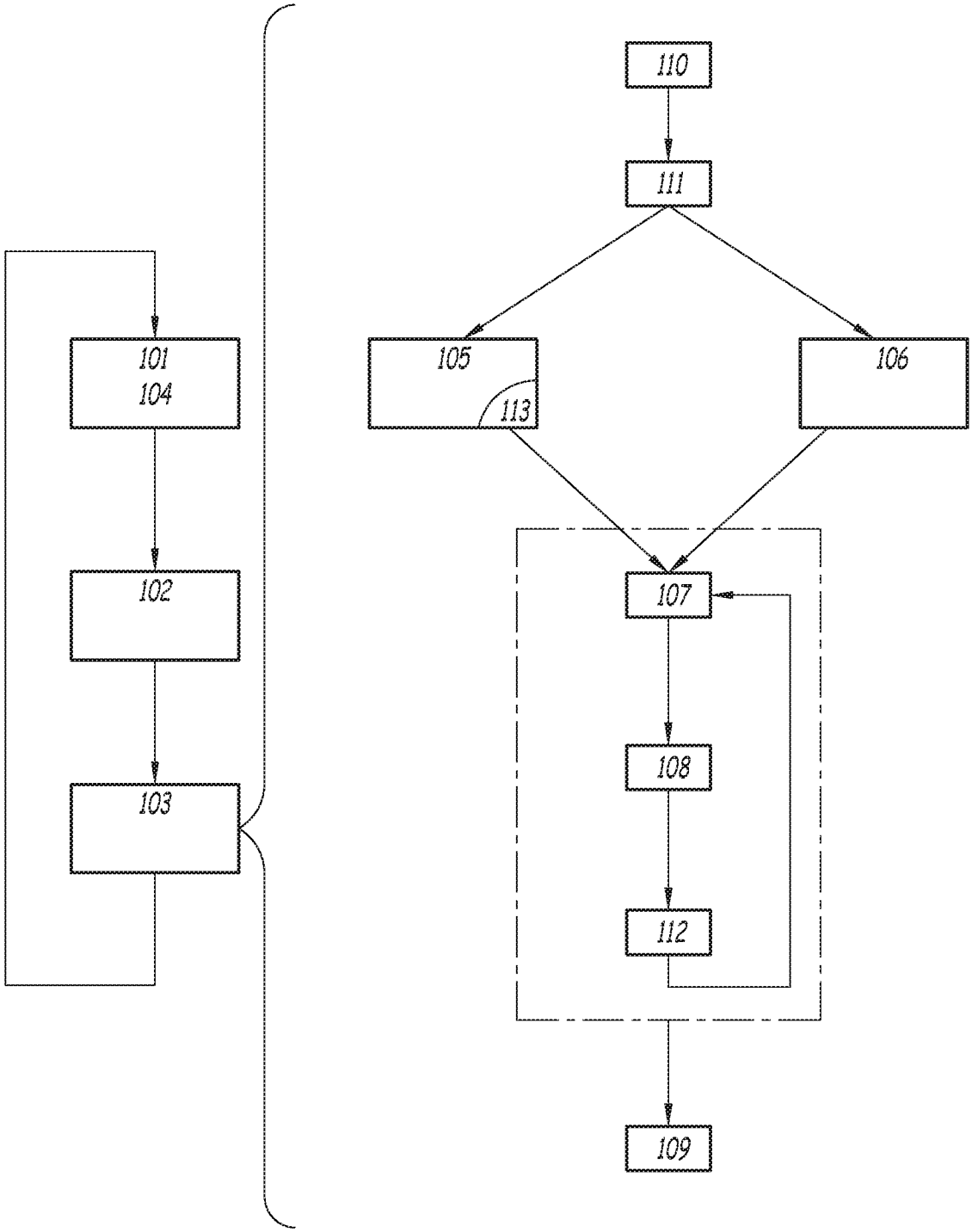

The invention will now be explained in reference to the annexed drawings, as an illustrative example. In the annexed drawings:

FIG. 1 is a schematic architectural view or the traffic management system of the invention, and FIG. 2 is a diagrammatic view of the traffic management method of the invention.

As depicted on FIG. 1, the traffic management system 1 is configured for interacting with traffic 2 and with a transportation network 3 used by said traffic 2.

In the present example, the traffic 2 comprises a set of trains, or any other similar vehicles, that use a set of resources of the transportation network 3. In this example, the transportation network 3 is a railway transportation network. Thus, the resources may comprise sections of tracks, switches, stations, or any other component typical of a railway transportation network. Some of said resources are linked together, so that one of the trains may circulate between two linked resources. Two linked resources are for example formed by two successive sections of tracks. Two resources may also be linked through a third resource of the network 3, as a first track section may for example be accessed by a train from a second track section through a third track section linked to both of the first and second track sections. Each of the resources is said to be "occupied" when one or more trains use the resource and that no more train may use said resource at the same time without conflicting the trains already using said resource. Thus, a conflict may occur between two or more trains that attempt to occupy the same resource. In addition, a conflict may occur between two or more trains that attempt to occupy two incompatible resources, namely different resources that cannot be used at the same time for safety constraints.

The system 1 depicted on FIG. 1 comprises a traffic manager 4, for managing the traffic 2. The traffic manager 4 is configured to obtain and store data relating to the network 3 and to the traffic 2, through suitable communication means 6. The traffic manager 4 is also configured to manage the traffic 2 on the network 3 by sending orders to said network 3 and traffic 2, through said communication means 6. The orders are for example sent to the traffic 2, for example by means of modifications of signals of the network 3, like speed limitation signals, home signals or semaphore signals. Some orders are sent to the network 3, like modifying the status of switch or other components.

The traffic manager 4 is configured to manage the traffic 2 and the network 3 according to a basis instruction timetable, which includes instructions about which route or action each train of the traffic 2 should take on the network 3, and at what time such a route or action should be taken.

The manager 4 may also interact with a human operator 5, for example through an interface 7 of the system 1. The main task of the operator 5 is to take decisions relative to the management performed by the manager 4. In particular, the operator 5 may validate and edit the instruction timetable to be used by the manager 4.

The instruction timetable is obtained by computing means of the system 1, including a conflict detection and solution module 8. Thus, the manager 4 constitutes a decision support system through which the operator 5 may manage and monitor the traffic 2 as well as the network 3. The operator 5 is helped and advised by the system 1 in the management and monitoring of the traffic 2 and the network 3.

The conflict detection and solution module 8 interacts with the manager 4 through a communicator 9. The communicator 9 is for example a data bus of the system 1. The module 8 itself is preferably automatic and thus does not need human intervention for functioning. Data relative to the traffic 2, the network 3 and the instruction timetable is sent to the module 8 through the communicator 9.

The module 8 comprises an automatic conflict detector 10, which is fed with said data. Conflict detector 10 is configured to detect conflicts in current traffic 2 based on said data. Based on said data, conflict detector 10 may also be configured to predict by calculation, in anticipation, future conflicts that may occur in said traffic 2, in the knowledge that said traffic 2 is being managed by the instruction timetable.

The traffic management system 1 further comprises a conflict solver 12, which is configured for generating a conflict solution in knowledge of the detected and/or predicted conflicts. The generation this conflict solution may be performed each time a conflict is detected and/or predicted by the conflict detector 10, or at a predetermined time frequency. The conflict solver 12 is configured for generating the conflict solution over a scheduling period of time in the near future, starting from the current time. The duration of the scheduling time, for which the conflict solution is to be generated, may be chosen by the operator 5 through the manager 4. The conflict solution comprises in particular a set of routes to be used by the vehicles on the transportation network 3, these routes being programmed over the scheduling period. When the traffic 2 is managed according to the conflict solution, the detected conflict is supposedly avoided in the scheduling period of time considered, unless a disruption in the traffic 2 or the network 3 occurs, generating further conflicts.

After said conflict solution is generated, the manager 4 is provided with this conflict solution through the communicator 9. Thus, the manager 4 manages the traffic 2 and the transportation network 3 with a modified instruction time table, based on the generated conflict solution and decisions of the operator 5, who validates the conflict solution. Thus, the traffic 2 uses the network 3 with a reduced number of conflicts, or even no conflict. The conflict solver 12 generates conflict solutions so as to update the basis instruction time table of the manager 4 so that conflicts are avoided as much as possible. Preferably, the conflict solution is generated according to several parameters, for the modified time table to be the least costly in terms of drawbacks, such as the amount of violated service intentions, delays, energy consumption by the trains, failure of dependencies between trains, detours taken by trains, increase of travelling time, or the like. Thus, the conflict solution provided to the manager 4 aims to resolve conflicts of the traffic 2 with reduced economic, service and environmental impact.

The conflict solver 12 comprises a pre-processor 14, included in the same architectural module than the conflict detector 10. The conflict solver 12 further comprises an optimizer 16 separate from the conflict detector 10 and included in the module 8. The pre-processor 14 is linked to the optimizer 16 by communication means 18.

The pre-processor 14 comprises an automatic splitter 20, an automatic local solver 22, a dependency grouper 24, a time range grouper 26 and a combiner 28.

The automatic splitter 20 is configured for virtually splitting the transportation network 3, for calculation purposes, into one or more local parts and one complementary part.

Each local part includes an area of the network 3 where one of the conflicts is involved. More precisely, each local part is defined where the trains of the traffic 2 in conflict are located, and includes local occupied resources of the network 3, which are occupied by said trains involved in the conflict. In addition, each local part includes local linking resources, which link together the local occupied resources. The amount of linking resources included in each local part is determined in accordance to several parameters. The splitter 20 chooses which resource is to be included to the set of resources to be considered as local linking resources according to said parameters. In particular, choosing the local linking resources is done according to a depth value, which may be chosen by the operator 5 or chosen during initialization or setting of the system 1.

Optionally, the grouper 24 determines groups of vehicles among the set of vehicles of the traffic 2: this grouping is performed so that the vehicles of a same group are related by one or more traffic dependencies, while the vehicles belonging to different groups are not related by a dependency, or by dependency of importance considered negligible. A traffic dependency is a link between two or more trains, such as shared rolling stocks or shared crew members. In practice, trains linked by a dependency are dependent and are to be managed in dependence from one another on the network 3.

The complementary part of the network 3 is distinct from the local parts, and constitute the rest of the network 3 not considered as a local part. Thus, the local parts are complementary to the complementary part, so that all these parts together constitute an illustration of the whole transportation network 3.

The automatic local solver 22 is configured for generating one local solution for each of the split local parts of the transportation network 3. Every one of these local solutions is only relative to one of the local parts, virtually excluding the complementary part. Optionally, each local solution is generated for only the groups of vehicles comprising the vehicles involved in conflicts. Thus, the groups of vehicles not involved in conflicts are ignored by the pre-processor 14. Consequently, each of these local solutions is very fast to be computed, considering the reduced number of possibilities by exclusion of the complementary part, and optionally of the groups of vehicles not involved in conflicts.

The local solutions generated by the pre-processor 14 are fed to an automatic complementary solver 30 of the optimizer 16, through the communication means 18. The complementary solver 30 is configured to generate a complementary solution for only the complementary part of the transportation network 3, starting from the local solutions provided by the pre-processor 14. The complementary solver 30 generates the complementary solution based on the set of routes that has already been fixed by the pre-processor 14 for the local parts of the network 3. Advantageously, the complementary solution is performed for the group of vehicles which does not comprise vehicles involved in the conflict, depending on the local solutions found for the group of vehicles including vehicles involved in said conflicts.

The number of potential possibilities for rerouting the traffic 2, that the complementary solver 30 needs to contemplate for solving, is reduced. Starting from this imposed set of local routes, the complementary solver 30 is able to generate quite easily the complementary solution.

Then, the complementary solver 30 sends back the generated complementary solution to the pre-processor 14 through the communication means 18. The automatic combiner 28 of the pre-processor 14 is configured to automatically combine the local solutions with the complementary solution for obtaining the conflict solution, by connecting the set of routes of the local solutions and the set of routes of the complementary solution for forming the conflict solution to be sent to the manager 4. In view of the above, the generation of the conflict solution is very fast and reliable, so that it can be advantageously performed in real-time. The instruction timetable may be optimized at a very high frequency.

As an optional feature, the time range grouper 26 is configured for automatically splitting the scheduling period into successive time rangers covering a part only of the scheduling period. The local solver 22 may be configured for generating local solutions sequentially for the split time ranges. Complementarily, the complementary solver 30 may be configured to generate complementary solutions for each of the split time ranges.

As an example, more precisely, the scheduling period may be split into successive first, second and third time ranges. In this example, the local solver 22 firstly generates a first local solution relative to only the first time range and to the local part. Then, the complementary solver 30 generates a first complementary solution relative only to the first time range and to the complementary part. The first complementary solution is generated in consideration of the first local solution. The combiner 28 automatically combines the first local solution with the first complementary solution for obtaining a first time range solution. The first time range solution corresponds to a set of routes related to the whole transportation network 3, but for only the first time range of the scheduling period. Afterwards, a second local solution is generated automatically by the local solver 22, relative to only the second time range and the local part and in consideration of the first time range solution. In other words, the second local solution is built starting from the set of routes of the first time range solution, determined for the first time range. A second complementary solution is then automatically generated by the complementary solver 30, relative to the complementary part in consideration of the second local solution. The combiner 28 combines the second local solution with the second complementary solution for generating the second time range solution. In a similar manner, a third local solution is generated for the third time range and is combined with a third complementary solution generated for the third time range, into a third time range solution. In the end, the three time range solutions generated according to the above-mentioned pattern are automatically combined together by the combiner 28, for forming the conflict solution. Thanks to the above-mentioned patterns, the computing time of the conflict solver 12 is further reduced.

The scheduling period may be split into two or more successive time ranges and that as much time range solutions may be generated and combined for obtaining the conflict solution.

The system 1 described above is preferably implemented by one or more computers and/or one or more servers linked together by a data network.

As a summary, the traffic management system 1 described above is configured to perform the steps of the traffic management method according to the invention, and depicted on FIG. 2.

This method comprises a step 101 of managing the traffic 2 and transportation network 3, according to a basis instruction time table, a step 102 of automatically detecting and/or predicting at least one conflict in the traffic 2, a step 103 of automatically generating a conflict solution, in knowledge of the conflict and a step 104 of managing the traffic 2 and the transportation network 3 with a modified instruction time table based on the generated conflict solution.

Step 103 comprises a sub-step 110 of choosing a scheduling period, or using a predetermined scheduling period, and a sub-step 111 automatically splitting the scheduling period into successive time ranges.

Step 103 comprises a sub-step 105 of automatically splitting the transportation network 3 into local parts and complementary part. The sub-step 105 includes an elementary step 113 of choosing which resources are to be considered as local linking resources. Step 103 also comprises a sub-step 106 of automatically identifying groups of vehicles among the set of vehicles.

For a considered time range, sub-step 106 is followed by a sub-step 107 of automatically generating at least one local solution relative only to the local part, for the group of vehicles comprising vehicles involved in the conflict.

Afterwards, for the considered time range, step 103 comprises a sub-step 108 of automatically generating at least one complementary solution relative only to the complementary part, the complementary solution being generated in consideration of the local solution, for the group of vehicles which does not comprise vehicles involved in the conflict.

After the sub-steps 107 and 108 are performed, a further sub-step 112 of automatically combining the local solution with the complementary solution for obtaining a time range solution. The sub-steps 107, 108 and 112 are repeated for each time range.

Step 103 further comprises a sub-step 109 of automatically combining the time range solutions together for obtaining the conflict solution.

The embodiments and features described above may be combined for generating further embodiments of the invention.

The invention claimed is:

1. A traffic management method, for managing traffic of a transportation network, the method comprising the steps of:

managing the traffic and the transportation network, according to a basis instruction timetable, by sending orders to said traffic and to said transportation network from a manager of a centralized traffic management system, automatically detecting and/or predicting at least one conflict in the traffic, generating a conflict solution in knowledge of the conflict, and managing the traffic and the transportation network with a modified instruction timetable based on the generated conflict solution, wherein the step of generating the conflict solution comprises at least the sub-steps of:

automatically splitting the transportation network into;

at least one local part, in which the conflict is involved, each local part including an area of the transportation network where one of the conflicts is involved, and a complementary part distinct from the local part, said complementary part constituting the rest of the transportation network not considered as local part, said local part and complementary part together constituting the whole transportation network, automatically generating at least one local solution relative only to the local part, automatically generating at least one complementary solution relative only to the complementary part, the complementary solution being generated in consideration of the local solution, and automatically combining the local solution with the complementary solution for obtaining the conflict solution.

2. The traffic management method according to claim 1, wherein:

the traffic comprises a set of vehicles using the transportation network, and the conflict solution is a set of routes to be used by said vehicles on the transportation network and in which the conflict is avoided.

3. The traffic management method according to claim 2, wherein the step of generating the conflict solution comprises a sub-step of automatically identifying groups of vehicles among the set of vehicles, the vehicles belonging to the same group being related by at least one traffic dependency, and the vehicles belonging to a different group not being related by a traffic dependency, the sub-step of generating the local solution is performed only for the group of vehicles comprising vehicles involved in the conflict, and the sub-step of generating the complementary solution is performed for the group of vehicles which does not comprise vehicles involved in the conflict.

4. The traffic management method according to claim 2, wherein:

the transportation network comprises a set of resources, each of said resources may be occupied by at least one of the vehicles from the set of vehicles, and the local part of the transportation network comprising at least:

local occupied resources, which are occupied by the vehicles involved in the conflict, and local linking resources, which link together the local occupied resources.

5. The traffic management method according to claim 4, wherein the sub-step of automatically splitting the transportation network comprises an elementary step of choosing which resources of the set of resources are to be considered as local linking resources, according to a depth value.

6. The traffic management method according to claim 1, wherein the step of generating the conflict solution further comprises the sub-steps of:

choosing a scheduling period for which said conflict solution is to be generated, automatically splitting the scheduling period into successive time ranges, including at least a first time range and a second time range, automatically generating a first local solution, relative only to the first time range relative and the local part, automatically generating a first complementary solution, relative only to the first time range and to the complementary part, the first complementary solution being generated in consideration of the first local solution, automatically combining the first local solution with the first complementary solution for obtaining a first time range solution, automatically generating a second local solution, relative only to the second time range relative and the local part, in consideration of the first time range solution, automatically generating a second complementary solution, relative only to the second time range and to the complementary part, the second complementary solution being generated in consideration of the second local solution, automatically combining the second local solution with the second complementary solution for obtaining a second time range solution, and automatically combining the first time range solution and the second time range solution for obtaining the conflict solution.

7. The traffic management method according to claim 1, wherein the step of generating the conflict solution is performed each time a conflict is detected or predicted.

8. The traffic management method according to claim 1, wherein the transportation network is a railway transportation network.

9. The traffic management method according to claim 8, wherein the orders are sent to:

the traffic, by modifications of signals of the transportation network, and the transportation network, for modifying the status of a component of the transportation network.

10. A centralized traffic management system configured to manage traffic of a transportation network, comprising:

a manager configured to manage the traffic and the transportation network according to a basis instruction timetable by sending orders to said traffic and to said transportation network, an automatic conflict detector, configured to detect and/or predict at least one conflict in the traffic, and a conflict solver configured to generate a conflict solution in knowledge of the conflict and configured to provide the manager with the conflict solution so that said manager manages the traffic and the transportation network with a modified instruction timetable based on the generated conflict solution, wherein the conflict solver comprises:

an automatic splitter configured to split the transportation network into:

at least one local part, in which the conflict is involved, each local part including an area of the transportation network where one of the conflicts is involved, and a complementary part distinct from the local part, said complementary part constituting the rest of the transportation network not considered as local part, said local part and complementary part together constituting the whole transportation network, an automatic local solver configured to generate at least one local solution relative only to the local part, an automatic complementary solver configured to generate at least one complementary solution relative only to the complementary part, the complementary solution being generated in consideration of the local solution, and an automatic combiner configured to combine the local solution with the complementary solution for obtaining the conflict solution.

* * * * *